US005151676A

United States Patent [19]

Sato

[11] Patent Number: 5,151,676

[45] Date of Patent: Sep. 29, 1992

[54] FILM RESISTANCE TERMINATOR

[75] Inventor: Shouichi Sato, Tagajo, Japan

[73] Assignee: Fujitsu Limited, Kawasaki, Japan

[21] Appl. No.: 582,210

[22] PCT Filed: Jan. 24, 1990

[86] PCT No.: PCT/JP90/00080

§ 371 Date: Oct. 2, 1990

§ 102(e) Date: Oct. 2, 1990

[87] PCT Pub. No.: WO90/09040

PCT Pub. Date: Aug. 9, 1990

[30] Foreign Application Priority Data

Feb. 2, 1989 [JP] Japan ..... 1-24626

Sep. 19, 1989 [JP] Japan ..... 1-242647

[51] Int. Cl.[5] ..... H01C 3/02

[52] U.S. Cl. ..... 338/61; 338/60; 333/22 R

[58] Field of Search ..... 338/61, 60; 333/238, 333/246, 22 R, 130

[56] References Cited

U.S. PATENT DOCUMENTS 4,413,241 11/1983 Bitoune et al. ..... 333/22 R

*Primary Examiner*—Marvin M. Lateef

*Attorney, Agent, or Firm*—Staas & Halsey

[57] ABSTRACT

A microwave film resistance terminator that includes a film resistor having the sufficient terminating characteristics even at high microwave frequencies. The invention uses a structure including a second film resistor (40) for cancelling inductive reactance element of the conventional first film resistor (30) is; and moreover, the inductive reactance of the film resistors (30, 31, 32) can be lowered by dividing the first film resistor (30) into a plurality of sections.

8 Claims, 6 Drawing Sheets

α ATTENUATION CONSTANT
β PHASE CONSTANT
ZR CHARACTERISTIC IMPEDANCE

FILM RESISTANCE TERMINATOR

FIELD OF THE INVENTION

The present invention relates to a terminator utilizing a film resistance. In more detail, the present invention particularly relates to a structure of resistive terminator which is to be used in the microwave frequency band and is constituted through use of microstrip line and film resistance.

BACKGROUND ART

A film resistance terminator is used for terminating the line by absorbing an energy propagated on the transmission line without reflection. In this case, absorbed energy is converted to heat. Namely, the film resistance terminator never reflects an input signal and is used, for example, to absorb the signal as a terminator of a hybrid circuit, etc.

A structure of an example of the conventional film resistance terminator is shown in FIG. 1 and FIG. 2. FIG. 1 is a plan view of a film resistance terminator, while FIG. 2 is a sectional view along the line Y-Y' in FIG. 1. In this figure, the numeral 10 designates a dielectric material substrate; 11, a conductor film; 12, a grounding conductor; 13, a first microstrip line; 14, a second microstrip line; 15, a conductor ribbon; 30, a film resistance consisting of a thin or thick film such as a tantalum nitride.

A structure of the film resistance will then be explained. A flat area is formed as a step-down area at a part of the grounding conductor 12. On this flat area, the dielectric material substrate 10 covered with the conductor film 11 at the rear surface thereof is mounted. Moreover, a first microstrip line 13 as a signal input part, a film resistor 30 which becomes a termination resistor connected to the first microstrip line 13 and a second microstrip line 14 for grounding the film resistor 30 are formed on the dielectric material substrate 10. In this case, the second microstrip line 14 is arranged at the end part of dielectric material substrate 10 and is almost flat for the upper step surface of the grounding conductor 12. Moreover, the conductor film 11 at the rear surface of the dielectric material substrate 10 is provided in close contact with the flat area of the grounding conductor 12. In addition, the conductor ribbon 15 is formed to electrically connect the second microstrip line 14 and the grounding conductor 12. Regarding the characteristic and size of each element, for example, the dielectric material substrate 10 is formed by alumina ceramics having the curve A, dielectric constant of 9.8 and thickness of 0.38 mm. The microstrip lines 13, 14 are formed by the conductor in the width of 0.36 mm and thickness of 0.003 mm, while the second microstrip line 14 has the length of 0.1 mm. The film resistor 30 has the width of 0.3 mm and length of 0.3 mm.

In this structure, for functioning as a terminator, the characteristic impedance of the first microstrip line is set equal to a DC resistance value of the film resistor for impedance matching. In this case, the characteristic impedance of first microstrip line is set to 50 ohms and therefore, a DC resistance of film resistor 30 is also set to 50 ohms which is equal to such characteristic impedance. With such structure, the input signal is terminated.

A return loss at the conventional film resistance terminator described above, namley a rate of appearance of reflected wave for the input signal is by the curve A in FIG. 3. This graph indicates a result of calculation for obtaining a return loss through the simulation by inputting sizes of respective parts of the film resistance terminator and then changing the frequency of input signal.

As will be understood from the graph of FIG. 3, the structure of conventional film resistor provides a good return loss in the comparatively low frequency band but shows deterioration of return loss for higher frequency band.

Next, a cause of deterioration of return loss in such a higher frequency band will be discussed. A film resistor which is easily influenced by the frequency can be thought as a cause. Therefore, a method of obtaining an input impedance of transmission path which results in load termination as shown in FIG. 4 will be indicated in order to search the characteristics of film resistor.

$$Z_{in} = \frac{Z_R \cdot (K^2 - 1 + j2K\sin 2\beta 1)}{(K^2 + 1 + j2K\sin 2\beta 1)}$$

Here, $K = \exp(2\alpha 1)$ and the characteristic impedance $Z_R$ is indicated by the following formula.

$$Z_R = [(R_0 + j\,\omega L_0)/(G_0 + j\omega C_0)]^{\frac{1}{2}}$$

Where, $R_0$; resistance per unit length $G_0$; conductance per unit length $L_0$; inductance per unit length $C_0$; capacitance per unit length Here, if $G_0 >> \omega C_0$, $$Z_R = Z_0\,(1 - j \cdot R_0/\omega L_0)^{\frac{1}{2}}$$

Where, $Z_0 = (L_0/C_0)^{\frac{1}{2}}$

It is the chatacteristic impedance of no-loss transmission path.

When $Z_R = R_R - jX_R$, the imput impedance $Z_{in}$ becomes as follow.

$$Z_{in} = (R + jX)/(K^2 + 1 + 2K\cos 2\beta 1) \quad (1)$$

Here, $$R = R_R(K^2 - 1) + 2KX_R\sin 2\beta 1 \quad (2)$$

$$X = 2KR_R\sin 2\beta 1 - X_R(K^2 - 1) \quad (3)$$

An input impedance can be obtained as explained above.

Namely, when an input impedance of film resistor is obtained by the method explained above, the value of imaginary part of formula (1) becomes larger as the frequency increases in the range from 1 to 20 GHz under the same condition. Namely, an inductive reactance of the input impedance considering the film resistor becomes large. Moreover, the inductive reactance element of the microstrip line 14 also increases by the same cause. When the inductive reactance becomes large, the impedance characteristic in the side of film resistance viewed from the first microstrip line 13 is deteriorated.

As explained above, the conventional film resistance terminator has resulted in a problem that it shows deterioration of return loss when the frequency becomes high and does not provide sufficient termination characteristics.

SUMMARY OF THE INVENTION

It is an object of the present invention to provide a film resistance terminator which ensures good return loss in wide frequency band with a simplified structure and in more detail to provide a film resistance terminator which ensures good return loss by bringing the reactance element of film resistor as a part of the film resistance terminator close to zero.

In order to attain such object, the present invention provides, as the first means, a film resistance terminator using a film resistor as shown in FIG. 6, comprising a first microstrip line 13 which is formed on the dielectric material substrate 10 to propagate an input signal, a first film resistor 30 which is connected with the end of microstrip line at the one end and is grounded at the other end to terminate the input signal, and a second film resistor which is connected in parallel with the first film resistor 30 and has a capacitive reactance element to cancel the inductive reactance element of the first film resistor 30.

Moreover, the present invention also provides, as the second means, a film resistance terminator comprising a first microstrip line 13 which is formed on the dielectric material substrate 10 to propagate an input signal and a first film resistor which is connected to the end of microstrip line at the one end and is grounded at the other end to terminate the input signal as shown in FIG. 8, wherein the first film resistor is formed by dividing the width of the first film resistor and connecting in parallel a plurality of film resistors 31, 32, 33.

DESCRIPTION OF THE PREFERRED EMBODIMENTS

Figure 6:
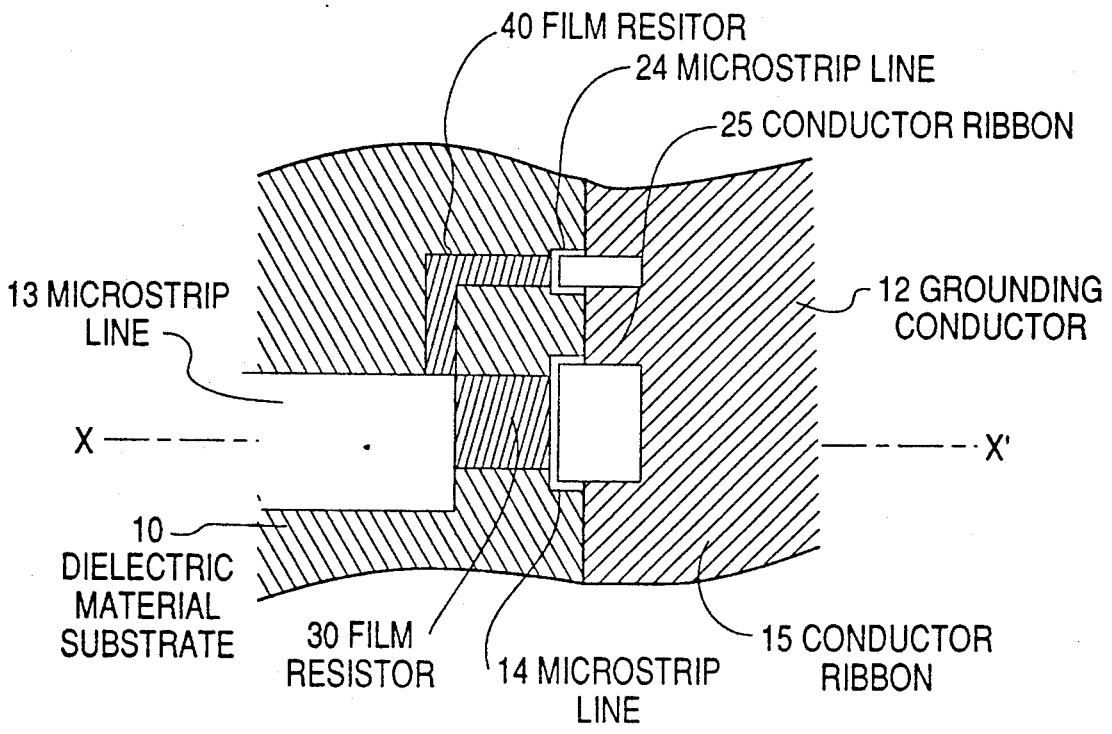
FIG. 6 indicates a first embodiment of the present invention.
Figure 7:
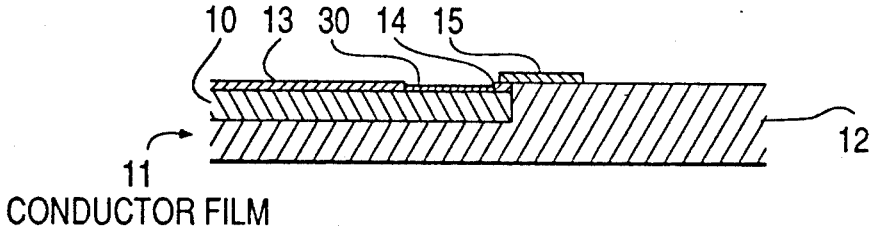
FIG. 7 is a sectional view along the line X-X' in FIG. 6.

The first embodiment of the present invention is shown in FIG. 6 and FIG. 7. FIG. 6 is a plan view of a film resistance terminator as an embodiment of the present invention and FIG. 7 is a sectional view along the line X-X' in FIG. 6. The like elements are designated by the like reference numerals throughout the drawings.

Figure 5A:
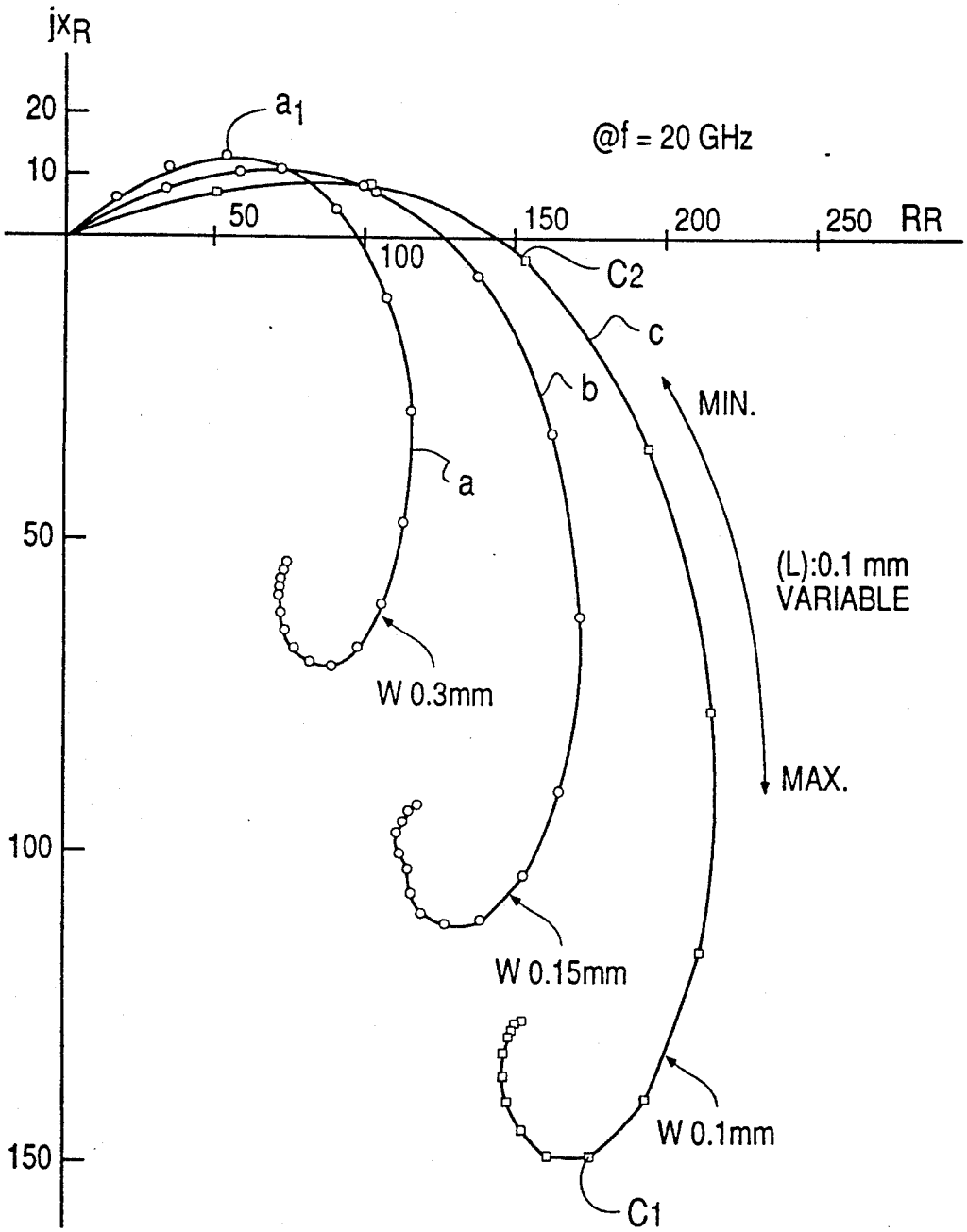
FIG. 5A shows input impendances when the length of various film resistors is changed.
Figure 5B:
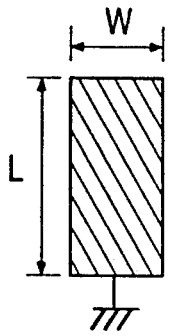
FIG. 5B shows the mode 1 of the graphs shown in FIG. 5A.

Moreover, FIG. 5A is given to explain input impedances of the film resistors using a mode 1 shown in FIG. 5B. In this figure, the frequency is considered to 20 GHz which is largely influenced by the reactance element. In this embodiment, the inductive reactance element by the film reistor can be cancelled by providing a film resistor having the other capacitive reactance element. Therefore, a film resistance terminator is formed through the best combination which provides the desired value of combined resistance value and a combined reactance element close to zero by changing the length of the film resistors in various sizes and drawing a plurality of loci as shown in FIG. 5A.

The present invention provides a film resistor 40 having a capacitive reactance for cancelling inductive reactance of the film resistor 30 to a film resistance terminator formed by the dielectric material substrate 10 that is covered with a conductor film 11 at the rear surface, a grounding conductor 12, microstrip lines 13, 14, a film resistor 30 and a conductor ribbon 15. Moreover, the microstrip line 24 for grounding the film resistor 40 and conductor ribbon 25 are further added.

Here, the dielectric material substrate 10 in this embodiment is formed by alumina ceramic with specific dielectric constant of 9.8 and thickness of 0.38 mm; the microstrip line 13 is formed by a conductor with width in the width of 0.36 mm and thickness of 0.003 mm. The microstrip line 14 for grounding the film resistor 30 has the width of 0.36 mm and length of 0.1 mm and this microstrip line 14 is grounded by the conductor ribbon 15. The film resistor 40 newly added has the width of 0.1 mm and length of 1 mm and the microstrip line 24 for grounding such film resistor has the width of 0.15 mm and length of 0.1 mm. The area resistivity of film resistor is 50 Ω/square.

For determination of above sizes, the following graph is generated. For instance, a graph indicating the input impedances of the film resistors in the width of 0.3 mm, 0.15 mm and 0.1 mm calculated by inputting the practical values to the formula (1) is shown in FIG. 5A. The horizontal axis of FIG. 5A denotes resistance element (herein after referred to as $R_{in}$), while the vertical axis, reactance element (hereinafter referred to as $X_{in}$). In the figure, a indicates an input impedance of the film resistor in the width of 0.3 mm, while b, that in the width of 0.15 mm and c, that in the width of 0.1 mm. This graph is obtained by plotting the impedances by changing the length of film resistor in the step of 0.1 mm under the frequency of 20 GHz.

In the case of graph a in FIG. 5A, when the length is 0, both $R_{in}$, $X_{in}$ are 0 Ω. When the length increases, both $R_{in}$, $X_{in}$ also increase at the beginning. But, $X_{in}$ is an inductive reactance element. When $R_{in}$ becomes almost 50 Ω, $X_{in}$ reduces, on the contrary. When $R_{in}$ becomes almost 90 Ω, $X_{in}$ changes to the capacitive reactance and increases. Moreover, $R_{in}$ reduces, on the contrary, from about 115 Ω, in addition, the capacitive reactance $X_{in}$ also reduces from almost 70 Ω, $R_{in}$ is converged almost to 75 Ω, while $X_{in}$ is converged to almost 50 Ω.

In the case of graph b in FIG. 5A, when the length is zero, both $R_{in}$ and $X_{in}$ are 0 Ω. When the length increases, both $R_{in}$, $X_{in}$ increase at the beginning. However, $X_{in}$ is inductive reactance element. When $R_{in}$ bocomes about 70 Ω, $X_{in}$ reduces on the contrary. When $R_{in}$ becomes almost 125 Ω, $X_{in}$ becomes capacitive reactance and increases. Meanwhile, $R_{in}$ reduces, on the contrary, from about 160 Ω and the capacitive reactance $X_{in}$ also reduces from about 110 Ω and $R_{in}$ is converted to almost 120 Ω, while $X_{in}$ to almost 95 Ω.

In the case of graph c in FIG. 5A, when the length is zero, both $R_{in}$, $X_{in}$ are 0 Ω. When the length increases, both $R_{in}$, $X_{in}$ increase at the beginning. However, $X_{in}$ is inductive reactance element. When $R_{in}$ becomes about 100 Ω, $X_{in}$ reduces on the contrary. When $R_{in}$ becomes almost 140 Ω, $X_{in}$ becomes capacitive reactance and increases gradually. When $R_{in}$ reches about 220 Ω, it gradually reduces on the contrary. In addition, the capacitive reactance $X_{in}$ gradually reduces from about 150 Ω and $R_{in}$ is converged to almost 150 Ω, while $X_{in}$ to about 125 Ω.

As will be understood from the above graph, the conventional film resistor 14 in this embodiment has the width of 0.3 mm and the length of 0.3 mm. Accordingly, it corresponds to the point a1 of the graph a, while $R_{in}$ is 54 Ω and inductive reactance element $X_{in}$ is about 13 Ω. Moreover, the film resistor 24 has the width of 0.1 mm and the length of 1 mm. Accordingly it corresponds to the point cl of the graph c, while $R_{in}$ is 180 Ω and capacitive reactance element $X_{in}$ is about 148 Ω. In this case, the combined $R_{in}$, $X_{in}$ of a couple of film resistors can be expressed by the following formula when the characteristic impedance of film resistor 14 is $(R_1+jX_1)$ and the characteristic impedance of film resistor 24 is $(R_2+jX_2)$.

$$R_{in} + jX_{in} = \frac{(R_1 + jX_1)(R_2 + jX_2)}{(R_1 + jX_1) + (R_2 + jX_2)}$$

From calculation of above formula, $$R_{in}+jX_{in}=48.56+j4.7$$

Figure 1:
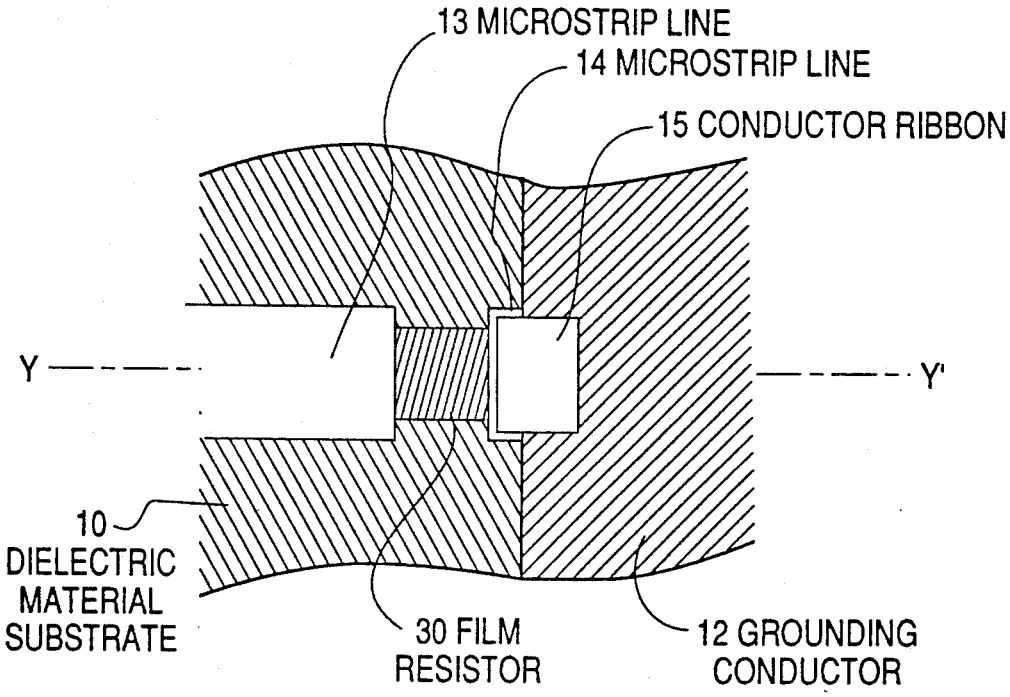
FIG. 1 PRIOR ART
FIG. 1 indicates a conventional film resistance terminator.
Figure 2:
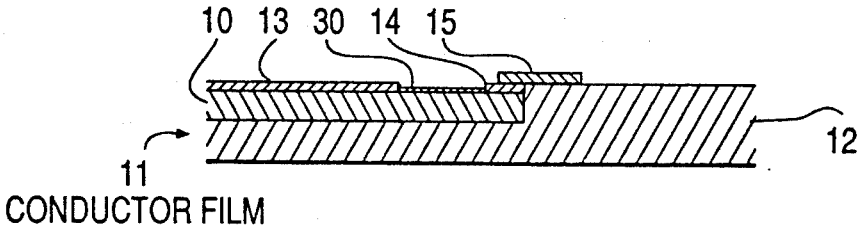
FIG. 2 PRIOR ART
FIG. 2 is a sectional view along the line Y-Y' in FIG. 1.
Figure 3:
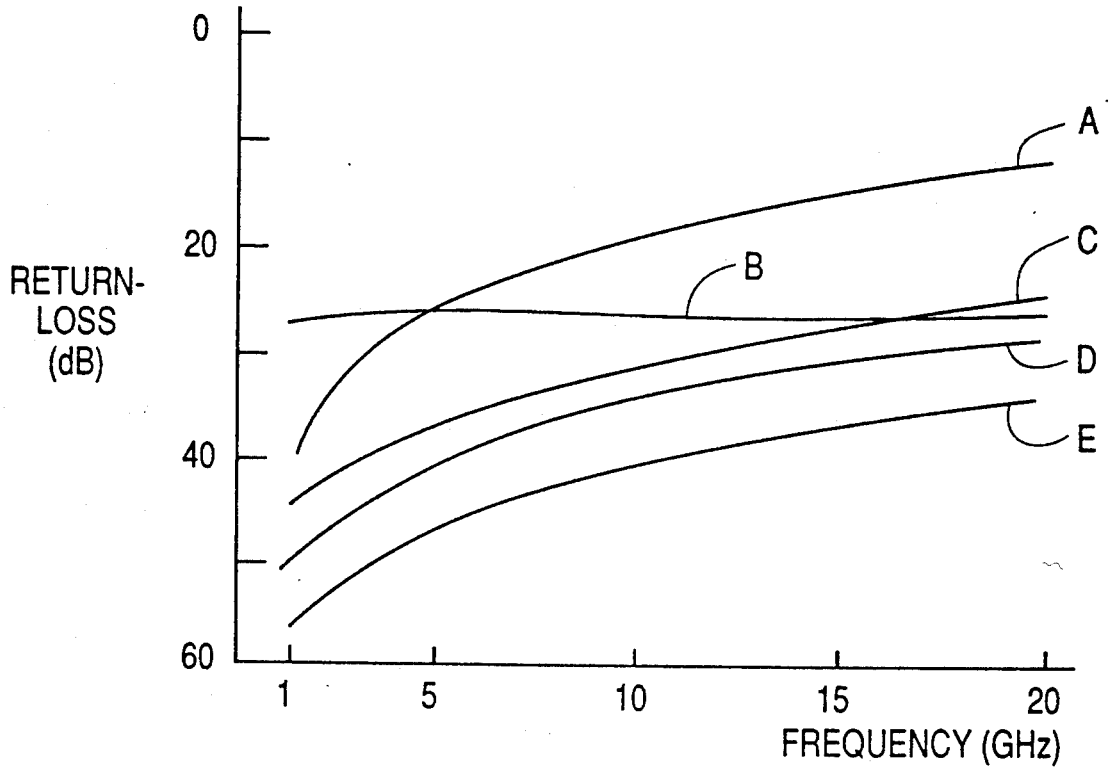
FIG. 3 shows return loss of various film resistance terminators.
Figure 4:
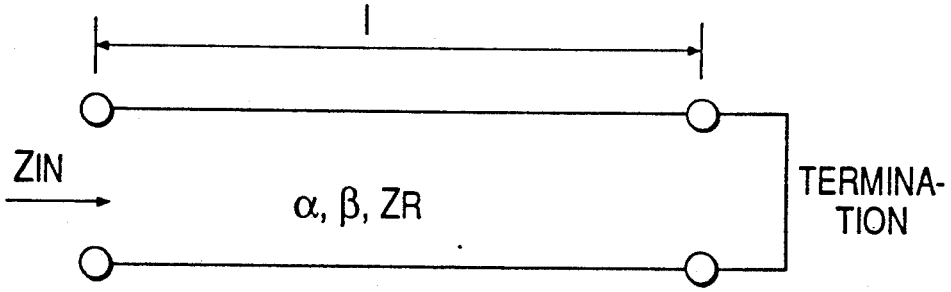
FIG. 4 PRIOR ART
FIG. 4 is a circuit of transmission line resulting in loss of load termination.

This is close to the desired resistance value, indicating that the reactance element becomes close to zero. Therefore, when the input signal is high frequency, a return loss can be improved. The return loss in the first embodiment of the above structure is a little deteriorated than the conventional one in the low frequency band as shown in FIG. 3B but is improved more than that of conventional one in the high frequency band. As a total, the return loss becomes 20 dB or more and total characteristic can be improved from the conventional one.

In addition, when the length of film resistor 14 is increased to 0.33 mm by about 0.03 mm, the resistance element becomes almost 50 Ω. In this case, as shown in FIG. 3C, the return loss may be improved even for the low frequency input signal.

As explained above, a film resistance terminator providing good return loss can be obtained by drawing locie for the film resistors of various sizes as shown in FIG. 5A and selecting the values resulting in the combined reactance element more closed to zero and the desired resistance value.

Figure 8:
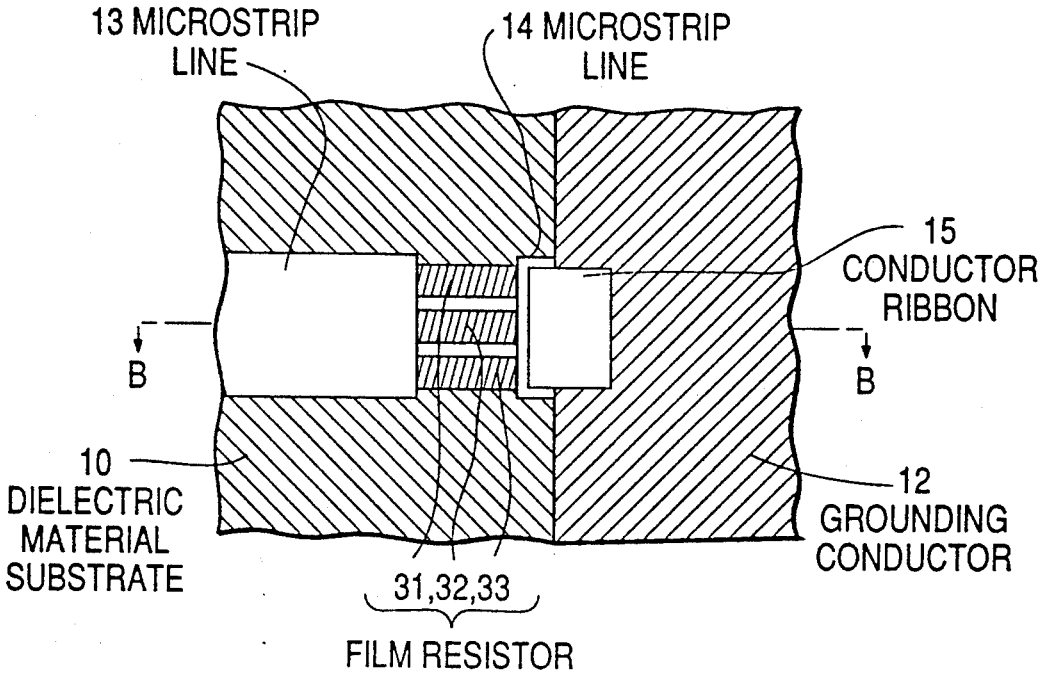
FIG. 8 indicates a second embodiment of the present invention.
Figure 9:
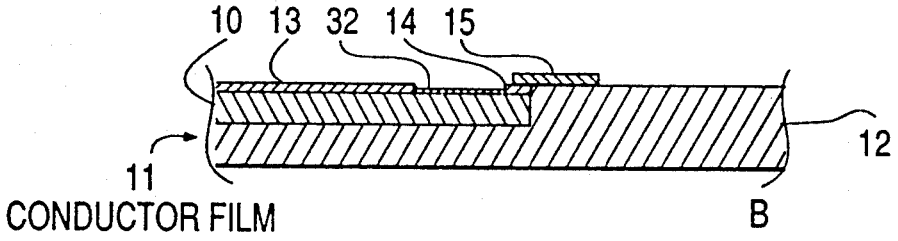
FIG. 9 is a sectional view along the line B-B' in FIG. 8.

Next, a second embodiment of the present invention will be shown in FIG. 8 and FIG. 9. FIG. 8 is a plan view of a film resistance terminator as the embodiment, while FIG. 9 is a sectional view along the line B-B' in FIG. 8. Like the prior art, this embodiment comprises a dielectric material substrate 10 covered with a conductive film 11 at the rear surface thereof, a grounding conductor 12, microstrip lines 13, 14 and a conductor ribbon 15. Moreover, this embodiment has the divided three film resistors 31, 32, 33 in place of the conventional film resistor 30. The dielectric material substrate 10 is formed by alumina ceramic having a specific dielectric constant of 9.8 in the thickness of 0.38 mm, the microstrip line 13 is formed by a conductor in the width of 0.36 mm and thickness of 0.003 mm, the microstrip line 14 connecting the film resistors 31, 32, 33 to the grounding conductor has the width of 0.36 mm and length of 0.1 mm and this microstrip line 14 is grounded by the conductor ribbon 15. The microstrip lines 31, 32, 33 have the width of 0.1 mm and length of 0.3 mm.

In general, a resistance value R of the film resistor is expressed as follow when the length of film resistor is 1 [mm], width is w [mm] and a resistivity is ρ [Ωmm].

$$R = (\rho/t)\cdot(l/w) = R_s(l/w)\ [\Omega]$$

$$R_s = (\rho/t)$$

Here, $R_s$ is an area resistivity and when the length 1 and the width w of film resistor are constant, the resistance value R depends only on the thickness t.

Meanwhile, when the thickness t is set to a constant value, the area resistivity $R_s$ also becomes constant and a resistance value R depends on the legnth and width w.

As shown in FIG. 8, the present embodiment obtains the desired resistance value as a combined resistance value by narrowing the width of one film resistor and increasing a resistance value of each film resistor by dividing a film resistor into a plurality of sections in the width direction and then connecting resistor sections in parallel.

Details are explained hereunder. As will be understood from the point c2 of graph c of FIG. 5A, the characteristic impedance of the film resistors 31, 32, 33 can be judged as follow from the sizes thereof that $R_{in}$ is about 150 Ω and $X_{in}$ is capacitive and several ohms. In this case, a total $R_{in}$ of the film resistors divided into three sections can be calculated as 50 Ω and it has the desired serial resistance value like the conventional one. On the contrary, the combined $X_{in}$ becomes very small in comparison with the conventional one because each reactance element is several ohms. Accordingly, deterioration of characteristic impedance of the microstrip line 13 is also lowered even under the high frequency band. Therefore, a measured return loss of this embodiment can be considerably improved in comparison with the conventional one as shown in FIG. 3D.

Figure 10:
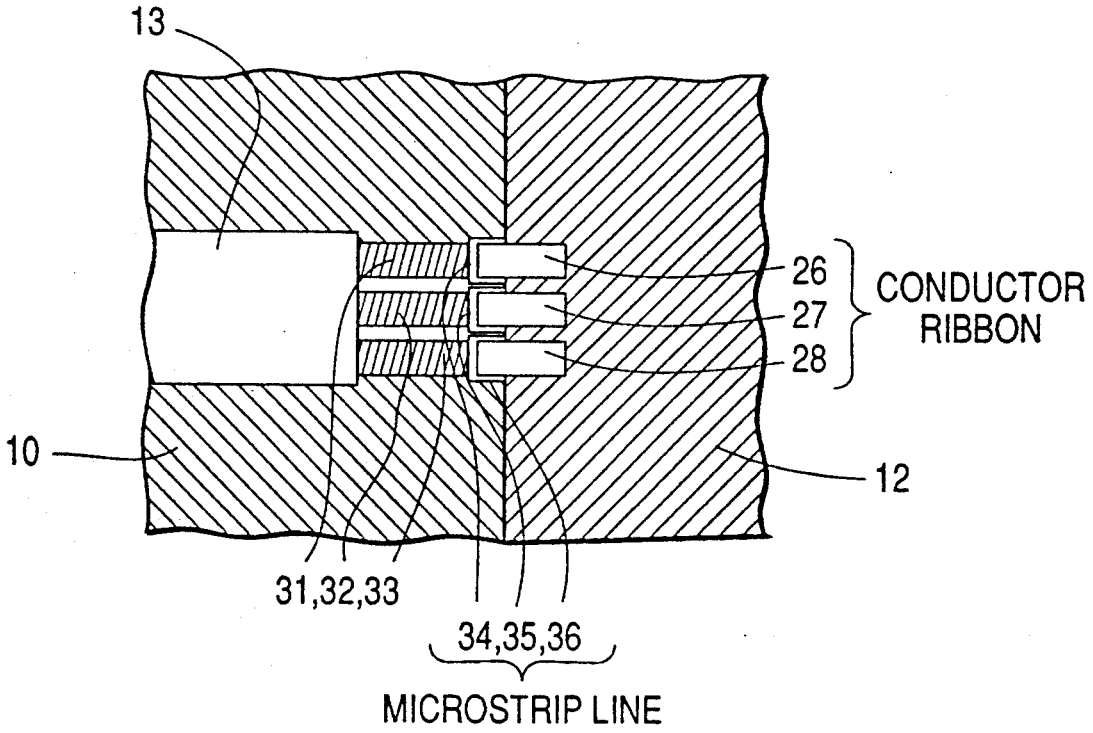
FIG. 10 is an application of the second embodiment as shown in FIG. 8.

Moreover, an application example of the second embodiment is shown in FIG. 10. In the terminator shown in FIG. 10, the microstrip line and conductor ribbon are also divided, in addition to the film resistor, corresponding thereto and thereby the microstrip lines 34, 35, 36 and conductor ribbons 26, 27, 28 are provided. In the second embodiment $X_{in}$ of the microstrip line 14 and conductor ribbon 15 is not considered but the reactance element is decreased by dividing the microstrip line 14 and conductor ribbon 15 like the film resistor. Accordingly, as shown in FIG. 3E, the return loss is more improved than the second embodiment.

The present invention has been explained by referring to the embodiments thereof. However, the microstrip line and grounding conductor may be connected electrically with a gold line in place of the conductor ribbon. In addition, a number of divisions of film resistor is not limited only to three sections considering the sizes thereof and the film resistor may also be divided into two sections. In this case, the width of the one film resistor becomes 0.15 mm. As will be understood from the graph b of FIG. 5A, the film resistor has the characteristics that $R_{in}$ is about 100 and $X_{in}$ is inductive resistance and becomes about 8 Ω. Accordingly, the combined $R_{in}$ of two film resistors is 50 Ω having a serial resistance value similar to that of conventional film resistor, while the combined $X_{in}$ becomes smaller than the conventional film resistor. However, in case the film resistor is divided into three sections, the reactance element becomes smaller and it is effective means. As explained above, the present invention is not limited only to such embodiments.

As explained previously, the present invention is capable of reducing reactance element of film resistors through employment of the structure for cancelling the reactance element of the conventional film resistor and the structure for dividing the film resistor. Therefore, deterioration of impedance characteristic of microstrip line 14 under the high frequency band may be lowered. As a result, return loss can be improved and sufficient termination can be realized even under the high frequency band.

I claim:

1. A film resistance terminator utilizing film resistors, comprising:

a dielectric material substrate;

a grounding conductor;

a first microstrip line formed on said dielectric material substrate to propagate an input signal;

a first film resistor having an inductive reactance and having a first end connected to an end part of said first microstrip line and a second end connected to said grounding conductor; and a second film resistor electrically connected in parallel with said first film resistor, and having a capacitive reactance, a combined reactance of said first and second film resistors is lower than the inductive reactance of said first film resistor.

2. A film resistance terminator according to claim 1, wherein a length and a width of said film resistor are selected so that a combined DC resistance element of said first film resistor (30) and second film resistor is almost equal to a resistance value of said first microstrip line.

3. A film resistance terminator according to claim 2, wherein said dielectric material substrate is positioned to be electrically connected to said grounding conductor conductor ribbons electrically connected to said grounding conductor;

second microstrip lines respectively connecting said first and second film resistors and corresponding ones of said conductor ribbons.

4. A film resistance terminator according to claim 2, said first microstrip line has a characteristic impedance of 50 Ω, said first film resistor has an area resistivity of 50 Ω/square, comprises tantalum nitride and has dimensions including a width.of 0.33 mm and length of 0.3 mm, said second film resistor has dimensions including a width of 0.1 mm and a length of 1 mm.

5. A film resistance terminator comprising:

a dielectric material substrate;

a grounding conductor;

a first microstrip line formed on said dielectric material substrate (10) to propagate an input signal;

a first film resistor comprising a plurality of sections electrically connected in parallel and between said first microstrip line and said grounding conductor.

6. A film resistance terminator according to claim 5, further comprising:

a conductor film positioned between said grounding conductor and said dielectric material substrate conductor ribbons electrically connected so said grounding conductor;

second microstrip line positioned to connect said first film resistor and said conductor ribbons and to connect said second microstrip line to said grounding conductor.

7. A film resistance terminator according to claim 6, wherein each of said second microstrip line and said conductor comprise respective pluralities of film resistors, each film resistor being connectable to ground.

8. A film resistance terminator according to claim 5, said microstrip line has a characteristic impedance of 50 Ω, said first film resistor being divided into three sections, and each of said film resistors being connected in parallel and comprising tantalum nitride having a width of 0.1 mm and a length of 0.3 mm.

* * * * *

UNITED STATES PATENT AND TRADEMARK OFFICE

CERTIFICATE OF CORRECTION

PATENT NO. : 5,151,676

DATED : SEPTEMBER 29, 1992

INVENTOR(S) : SHOUICHI SATO

It is certified that error appears in the above-identified patent and that said Letters Patent is hereby corrected as shown below:

Col. 1, line 51, "curve A," should be deleted.

Col. 2, line 5, "3, the" should be --3, curve A, the--;
line 16, after "resistor" insert the following:
--When $\alpha$; attenuation constant
$\beta$; phase constant
$Z_R$; characteristic impedance ($\Omega$),
an input impedance $Z_{in}$ of the transmission line is indicated by the following formula--;
line 58, "of film" should be --of the film--.

Col. 3, line 40, "mode 1" should be --model--;
line 62, "mode 1" should be --model--.

Signed and Sealed this

Twenty-eighth Day of September, 1993

Bruce Lehman

*Attest:*

BRUCE LEHMAN

*Attesting Officer*

*Commissioner of Patents and Trademarks*